United States Patent [19]

Gall

[11] Patent Number: 4,558,861

[45] Date of Patent: Dec. 17, 1985

[54] DRIVE SYSTEM FOR EXERCISE APPARATUS OR THE LIKE

[75] Inventor: John C. Gall, Chicago, Ill.

[73] Assignee: Sears, Roebuck & Co., Chicago, Ill.

[21] Appl. No.: 609,284

[22] Filed: May 11, 1984

[51] Int. Cl.[4] ..... A63B 69/16; A63B 21/00; F16D 51/00; F16D 51/02

[52] U.S. Cl. ..... 272/73; 272/131; 272/132; 188/77 R; 188/83

[58] Field of Search ..... 272/73, 132, 131, 116, 272/69; 411/400; 188/77 R, 77 W, 83, 26

[56] References Cited

U.S. PATENT DOCUMENTS

| | | | |
|---|---|---|---|
| 285,130 | 9/1883 | Hiester . | |
| 334,635 | 1/1886 | Bowen . | |
| 344,531 | 6/1886 | Howe . | |
| 346,667 | 8/1886 | Maret . | |
| 357,249 | 2/1887 | Valiquet . | |
| 410,367 | 9/1889 | Lough . | |
| 414,834 | 11/1889 | Autenrieth . | |
| 471,472 | 3/1892 | Fleming . | |
| 545,492 | 9/1895 | Hall . | |
| 586,142 | 7/1897 | Nichols . | |
| 619,072 | 2/1899 | Darby . | |
| 663,968 | 12/1900 | Johnson . | |
| 664,826 | 12/1900 | Weeks . | |
| 889,741 | 9/1908 | Lane et al. . | |
| 2,342,795 | 2/1944 | Durand | 192/5 |
| 2,459,879 | 1/1949 | Hardwick | 411/400 |
| 2,894,605 | 7/1959 | Leavitt | 188/77 R |
| 3,024,023 | 3/1962 | Steller | 272/73 |
| 3,216,722 | 11/1965 | Odom | 272/73 |
| 3,828,895 | 8/1974 | Boaz | 188/77 R |
| 3,845,663 | 11/1974 | Blomberg | 73/379 |
| 3,966,201 | 6/1976 | Mester | 272/72 |
| 3,967,503 | 7/1976 | Svensson | 73/379 |
| 3,995,491 | 12/1976 | Wolfla | 73/379 |
| 4,007,927 | 2/1977 | Proctor | 272/73 |
| 4,148,478 | 4/1979 | Moyski et al. | 272/73 |
| 4,305,578 | 12/1981 | Disbrow et al. | 272/132 X |

FOREIGN PATENT DOCUMENTS

| | | | |
|---|---|---|---|
| 1101356 | 10/1955 | France | 188/26 |
| 8037 | of 1898 | United Kingdom . | |
| 17680 | of 1915 | United Kingdom . | |

*Primary Examiner*—Richard J. Apley
*Assistant Examiner*—Kathleen D'Arrigo
*Attorney, Agent, or Firm*—Wood, Dalton, Phillips, Mason & Rowe

[57] ABSTRACT

A drive system for an exercise apparatus or the like. The system includes a rotatable member mounted on a frame together with a mechanism for rotating the rotatable member through a drive pulley operatively associated with the rotating mechanism and a driven pulley operatively associated with the rotatable member. It also includes an endless belt member drivingly interconnecting the pulleys such that the belt member imparts rotation of the rotating mechanism to the rotatable member through the drive and driven pulleys which occurs because of the fact that an inner surface of the belt member is in driving engagement with the pulleys. The system further includes a component frictionally engaging an outer surface of the belt member in the area in which the inner surface of the belt member is in driving engagement with the drive pulley to impart a resistance to rotation of the rotating mechanism. With this construction, the drive system is suitable for an exercise apparatus or the like.

16 Claims, 4 Drawing Figures

DRIVE SYSTEM FOR EXERCISE APPARATUS OR THE LIKE

BACKGROUND OF THE INVENTION

The present invention generally relates to a drive system and, more particularly, to a drive system for an exercise apparatus or the like.

For many years, the benefits from use of an exercise apparatus in the form of a stationary bicycle have been known and appreciated. Such apparatus characteristically have mechanical braking means to simulate and vary bicycle pedal loading and a speedometer and odometer by means of which the user can monitor performance objectives. In most cases, these apparatus have a wheel or flywheel to provide inertial effects whereby the wheel or flywheel is commonly driven by means of a chain drive connected to a pedal driven sprocket. Such apparatus commonly apply the mechanical braking means to provide resistance of the type generally associated with bicycle pedal loading near or on the periphery of the wheel or flywheel. Although this design approach allows lower braking forces at higher speeds, it also dictates that the entire drive system be operated under substantial load.

Among the prior art devices are those disclosed in U.S. Pat. Nos. 334,635; 3,024,023; 3,216,722; 3,845,663; 3,996,201; 3,967,503; 3,995,491; 4,007,927; and 4,148,478.

In order to overcome the problems in the art, it is an object of the present invention to provide a drive system which eliminates the braking loads on the transmission means. Still other objects of the present invention will be apparent from a consideration of the details of construction and operation set forth hereinafter.

SUMMARY OF THE INVENTION

The present invention is directed to a drive system for use in an exercise apparatus in the form of a stationary bicycle. The system includes a rotatable member mounted on a frame together with means for rotating the rotatable member through a drive pulley operatively associated with the rotating means and a driven pulley operatively associated with the rotatable member. It also includes an endless belt member drivingly interconnecting the pulleys so as to impart rotation of the rotating means to the rotatable member through the drive and driven pulleys by means of the inner surface of the belt member being in driving engagement with the pulleys. The system further includes means for frictionally engaging an outer surface of the belt member in the area in which the inner surface of the belt member is in driving engagement with the drive pulley for imparting a resistance to rotation of the rotating means. With this construction, the present invention is able to overcome the problems with drive systems for exercising apparatus where the brake means is applied to the wheel or flywheel.

In a preferred embodiment, the frictional engagement means is preferably a band engaging the outer surface of the belt member along at least a portion of the circumferential extent of engagement of the belt member with the drive pulley. The drive system also suitably includes means for selectively varying the resistance imparted to rotation of the rotating means by increasing and decreasing the force of engagement of the band with the outer surface of the belt member to thereby selectively vary the friction therebetween, preferably by means of an adjustable spring mechanism. Still other advantageous details of construction include the band being greater in width than the belt member to aid in dissipating the heat generated by frictional resistance caused by the forced engagement of the band with the outer surface of the belt member.

When the drive system is used in an exercise apparatus of the stationary bicycle type, the rotatable member is preferably a rotatable wheel or flywheel member and the rotating means suitably comprises pedal means. It is also advantageous for a first end of the band to be mounted on the frame and for the adjustable spring mechanism to extend between a second end of the band and the frame. In a preferred embodiment, the adjustable spring mechanism includes a tension adjusting means typically a threaded U-bold mounted on the frame together with a spring extending between the second end of the band and the U-bolt.

Preferably, the circumferential extent of engagement of the belt member with the drive pulley is approximately 180°. It is then advantageous for the band to engage the outer surface of the belt member by an amount approaching the circumferential extent of engagement of the belt member with the drive pulley or, in other words, to extend circumferentially about the drive pulley for approximately 180°. Additionally, the band is preferably formed of metal and the belt member is preferably formed of a flexible material having a high friction surface.

Still other advantages and features of the present invention will become apparent from a consideration of the detailed description which follows when taken in conjunction with the accompanying drawings.

DETAILED DESCRIPTION OF THE PREFERRED EMBODIMENT

Figure 1:
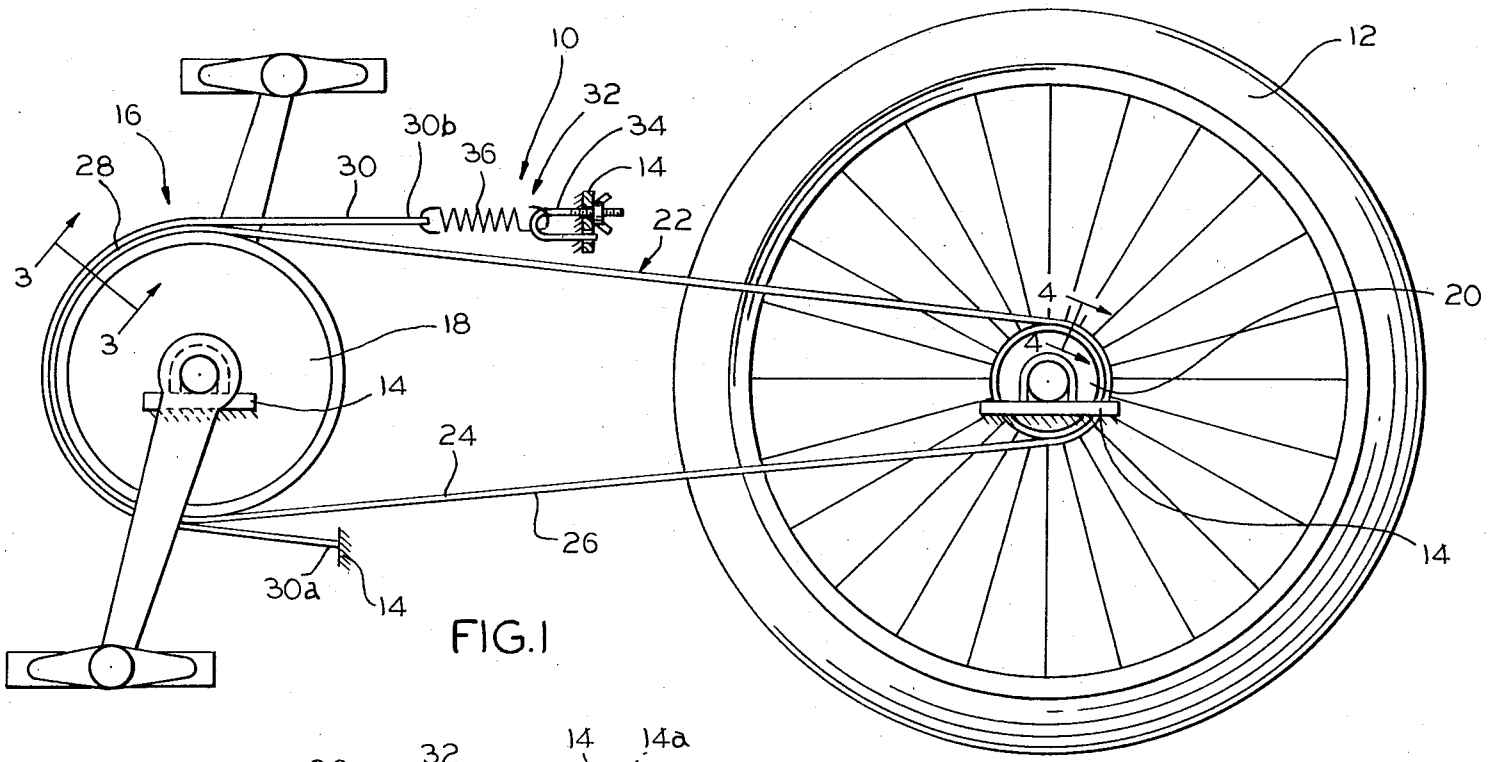
FIG. 1 is a side elevational view of the operative components of a drive system in accordance with the present invention.

Referring to FIG. 1, the reference numeral 10 designates generally a drive system in accordance with the present invention. The drive system 10 includes a rotatable member 12 together with means for rotating the rotatable member 12 such as the pedal means 16 both mounted on portions of the frame 14 (shown schematically). It also includes a drive pulley 18 operatively associated with the rotating means or pedal means 16 and a driven pulley 20 operatively associated with the rotatable member 12. The drive system 10 further includes an endless belt member 22 drivingly interconnecting the drive and driven pulleys 18 and 20, respectively, both of which are mounted on portions of the frame 14, to impart rotation of the rotating means or pedal means 16 to the rotatable member 12 (which in the case of an exercise apparatus comprises a wheel or flywheel), and the rotation is imparted through the pulleys by means of an inner surface 24 of the belt member 22 which is in driving engagement with the drive and driven pulleys 18 and 20, respectively. It also includes means for frictionally engaging the belt member 22 to impart a resistance to rotation of the rotating means or pedal means 16. The frictional engagement means preferably includes a band 30 engaging an outer surface 26 of the belt member 22 in the area 28 in which the inner surface 24 of the belt member 22 is in driving engagement with the drive pulley 18. With this construction, the drive system 10 is well suited for use as an exercising apparatus in the form of a stationary bicycle.

As shown, the band 30 engages the outer surface 26 of the belt member 22 along at least a portion of the circumferential extent of engagement of the belt member 22 with the drive pulley 18. The drive system 10 also preferably includes means for selectively varying the resistance imparted to rotation of the rotating means or pedal means 16, such as the adjustable spring mechanism 32 or any other mechanism providing the same or a similar operational effect, i.e., any mechanism which operates by increasing and decreasing the force of engagement of the band 30 (preferably formed of metal with the outer surface 26 of the belt member 22 (preferably formed of a flexible material or composite of materials having a high friction surface capable of withstanding heat generated by the frictional resistance of the band 30) for selectively varying the friction therebetween. Still referring to FIG. 1, a first end 30*a* of the band 30 is mounted on another portion of the frame 14 and the adjustable spring mechanism 32 extends between a second end 30*b* of the band 30 and still another portion of the frame 14.

Figure 2:
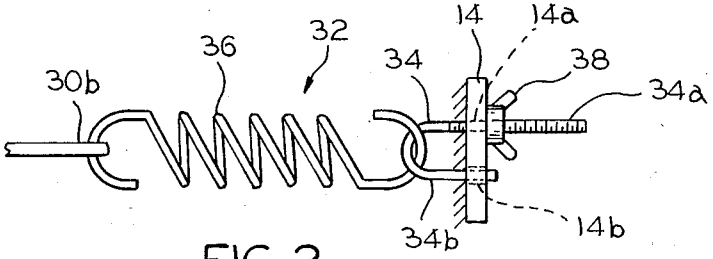
FIG. 2 is an enlarged detail view of the adjustable spring mechanism illustrated in FIG. 1.

Referring to FIG. 2, the adjustable spring mechanism 32 may include a tension adjusting means typically a threaded U-bolt 34 mounted on the frame 14 and also includes a spring 36 extending between the second end 30*b* of the band 30 and the U-bolt 34. It will be apparent that, as shown, the spring 36 is joined to both the band 30 and the U-bolt 34 in conventional fashion, and it will also be apparent that the U-bolt has one elongated threaded leg 34*a* extending through a first hole 14*a* in the frame 14 with the other leg 34*b* being significantly shorter but of sufficient length to extend through a second hole 14*b* in the frame 14. Also as shown, the U-bolt 34 is threadingly adjustable by means of a wing nut 38 on the elongated threaded leg 34*a* to increase and decrease the spring tension and thereby increase and decrease the force of engagement of the band 30 with the outer surface 26 of the belt member 22.

With regard to the frame 14, it will be appreciated that it has been shown schematically in FIG. 1. It will also be appreciated that only portions of the frame 14 have been illustrated and that the frame will, in practice, either be a unitary member or will be comprised of components normally fixed in relation to one another. Moreover, it will be appreciated that the remainder of the exercise apparatus can be conventional in design and has been omitted from the drawings for clarity.

Figure 3:
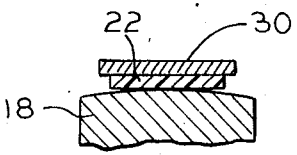
FIG. 3 is a cross sectional view taken on the line 3—3 of FIG. 1.
Figure 4:
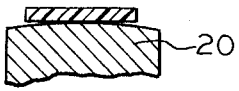
FIG. 4 is a cross sectional view taken on the line 4—4 of FIG. 1.

Still additional details of the present invention can be understood by referring to FIG. 3. It will there be seen that the band 30 is preferably greater in width than the belt member 22 (shown here as a flat belt but which could take other forms such as a V-belt with use of appropriate pulleys), and this difference in width aids in dissipating the heat generated by frictional resistance caused by the forced engagement of the band 30 with the outer surface 26 of the belt member 22 through the side edges of the band. The drive pulley 18 and driven pulley 20 may be slightly crowned or may be designed for use with V-belts in accordance with standard pulley principles.

Referring once again to FIG. 1, the circumferential extent of engagement of the belt member 22 with the drive pulley 18 is approximately 180°. It will also be seen that the band 30 engages the outer surface 26 of the belt member 22 along approximately one-half of the circumferential extent of engagement of the belt member 22 with the drive pulley 18, i.e., the band 30 extends circumferentially about the drive pulley 18 for approximately the same circumferential extend of engagement of the belt member 22 with the drive pulley 18, i.e., the band 30 extends circumferentially about the drive pulley 18 for approximately 180° providing the maximum area of heat generation and dissipation. With this construction, the braking force has been determined to be variable within limits of acceptability for exercise apparatus.

With the present invention, the drive system is particularly well suited for an exercise apparatus or the like. It overcomes the problems associated with prior exercise apparatus, particularly those in the form of a stationary bicycle, by eliminating any braking load or tensile force on the transmission means other than inertial effects since there are no mechanical braking means applied near or on the periphery of the rotatable wheel or flywheel member or, for that matter, anywhere on the flywheel. Instead, the flywheel is driven by a belt while a band brake is provided to encompass a portion of the belt in engagement with the drive pulley.

With this approach, the belt serves a dual function without being subjected to any braking loads. One side of the belt comprises the friction transmission means and the other side of the belt is the brake friction material. Since the belt member is compressed under the brake band, the degree of belt member tensile strength required is very low.

While the drive system is well suited for an exercise apparatus, it may also be used in any system requiring a resistance to rotation under certain conditions. The approach of the present invention, particularly for an exercise apparatus of the stationary bicycle type, should reduce the cost of the drive system, eliminate pedal load variations due to wheel or flywheel runout, and provide a smoother, quieter operation, particularly in view of the fact that the belt member is merely circumferentially or tangentially in contact with the band. Due to the elimination of chains and sprockets, the operation is smooth, quiet, effective and inexpensive.

Variations of the details herein given may be made by those skilled in the art without departing from the spirit and scope of the present invention as defined by the appended claims.

I claim:

1. A drive system, comprising:

a rotatable member mounted on a frame together with means for rotating the rotatable member;

a drive pulley operatively associated with the rotating means and a driven pulley operatively associated with the rotatable member;

a belt member drivingly interconnecting the drive and driven pulleys, the belt member imparting rotation of the rotating means to the rotatable member through the drive and driven pulleys, the belt member having an inner surface in driving engagement with the driven and driven pulleys; and means for frictionally engaging an outer surface of the belt member, the frictional engagement means engaging the outer surface of the belt member in the area in which the inner surface of the belt member is in driving engagement with the drive pulley, the frictional engagement means imparting a resistance to rotation of the rotating means.

2. The drive system as defined by claim 1 wherein the frictional engagement means is a band engaging the outer surface of the belt member along at least a portion of the circumferential extent of engagement of the belt member with the drive pulley.

3. The drive system as defined by claim 2 including means for selectively varying the resistance imparted to rotation of the rotating means by increasing and decreasing the force of engagement of the band with the outer surface of the belt member for selectively varying the frictional resistance therebetween.

4. The drive system as defined by claim 3 wherein the means for selectively varying the frictional resistance between the band and the outer surface of the belt member includes a tension adjusting means for increasing and decreasing the force of engagement of the band with the outer surface of the belt member.

5. The drive system as defined by claim 4 wherein the band is greater in width than the belt member to aid in dissipating the heat generated by frictional resistance caused by the forced engagement of the band with the outer surface of the belt member.

6. The drive system as defined by claim 2 wherein the circumferential extent of engagement of the belt member with the drive pulley is approximately 180° and the band engages the outer surface of the belt member along approximately one-half of the circumferential extent of engagement of the belt member with the drive pulley.

7. The drive system as defined by claim 2 wherein the band is formed of metal and the belt member is formed of flexible material having a high friction surface.

8. In an exercise apparatus having a frame, a rotatable wheel mounted on the frame, and pedal means for rotating the wheel, the improvement comprising:

a drive pulley operatively associated with the pedal means and a driven pulley operatively associated with the wheel;

a belt member drivingly interconnecting the drive and driven pulleys, the belt member imparting rotation of the pedal means to the wheel through the drive and driven pulleys, the belt member having an inner surface in driving engagement with the drive and driven pulleys; and means for frictionally engaging an outer surface of the belt member, the frictional engagement means engaging the outer surface of the belt member in the area in which the inner surface of the belt member is in driving engagement with the drive pulley, the frictional engagement means imparting a resistance to rotation of the pedal means.

9. The exercise apparatus as defined by claim 8 wherein the frictional engagement means is a band engaging the outer surface of the belt member along at least a portion of the circumferential extent of engagement of the belt member with the drive pulley.

10. The exercise apparatus as defined by claim 9 including means for selectively varying the resistance imparted to rotation of the pedal means by increasing and decreasing the force of engagement of the band with the outer surface of the belt member for selectively varying the frictional resistance therebetween.

11. The exercise apparatus as defined by claim 10 wherein the means for selectively varying the frictional resistance between the band and the outer surface of the belt member includes a tensioning adjusting means for increasing and decreasing the force of engagement of the band with the outer surface of the belt member.

12. The exercise apparatus as defined by claim 11 wherein a first end of the band is mounted on the frame, the tensioning adjusting means extending between a second end of the band and the frame, the tensioning adjusting means including a threadingly adjustable U-bolt mounted on the frame.

13. The exercise apparatus as defined by claim 12 wherein the tensioning adjusting means includes a spring extending between the second end of the band and the U-bolt, the U-bolt being threadingly adjustable by means of a nut to increase and decrease the force of engagement of the band with the outer surface of the belt member.

14. The exercise apparatus as defined by claim 11 wherein the band is greater in width than the belt member to aid in dissipating the heat generated by frictional resistance caused by the forced engagement of the band with the outer surface of the belt member.

15. The exercise apparatus as defined by claim 9 wherein the circumferential extent of engagement of the belt member with the drive pulley is approximately 180° and the band engages the outer surface of the belt member along approximately one-half of the circumferential extent of engagement of the belt member with the drive pulley.

16. The exercise apparatus as defined by claim 9 wherein the band is formed of metal and the belt is formed of flexible material having a high friction surface.

* * * * *